US007708005B2

(12) United States Patent
Lackner

(10) Patent No.: US 7,708,005 B2
(45) Date of Patent: May 4, 2010

(54) APPARATUS AND METHOD FOR SPLITTING MASONRY MATERIALS

(76) Inventor: Raymond F. Lackner, 4741 Baldwin Manor Rd., Pittsburgh, PA (US) 15227

( * ) Notice: Subject to any disclaimer, the term of this patent is extended or adjusted under 35 U.S.C. 154(b) by 220 days.

(21) Appl. No.: 11/649,557

(22) Filed: Jan. 4, 2007

(65) Prior Publication Data

US 2008/0163858 A1 Jul. 10, 2008

(51) Int. Cl.
*B28D 1/32* (2006.01)

(52) U.S. Cl. ..... 125/23.01; 254/93 R; 254/89 HP; 254/93 L

(58) Field of Classification Search ..... 125/23.01; 254/93 R, 89 HP, 93 L
See application file for complete search history.

(56) References Cited

U.S. PATENT DOCUMENTS 2,368,138 A * 1/1945 Hayden ..... 125/23.01
2,746,447 A * 5/1956 Petch ..... 125/23.01
2,779,324 A * 1/1957 Schlough et al. ..... 125/23.01
3,077,214 A * 2/1963 Brukner ..... 144/193.1
3,727,600 A * 4/1973 Schlough ..... 125/23.01
6,568,577 B2 5/2003 Baird et al.

FOREIGN PATENT DOCUMENTS

DE 3249247 A1 * 2/1984
FR 2372338 A * 7/1978

* cited by examiner

*Primary Examiner*—Maurina Rachuba
(74) *Attorney, Agent, or Firm*—Carothers & Carothers

(57) ABSTRACT

An apparatus for splitting masonry material which includes a frame and table vertically moveable in the frame, the table also having an attached lower blade, for supporting masonry material thereon to be split. An upper blade is positioned in the frame over the table in alignment with the lower blade. A hydraulic jack with an extendable ram is also supported in the frame below the table and is actuated by an actuating lever to thereby raise the table and lower blade combination to engage masonry material supported thereon between the upper and lower blades for splitting. A mechanism for quickly raising the table with its attached lower blade and the ram of the hydraulic jack for initial fast engagement of the upper and lower blades with the masonry material to be split is provided upon initial actuation of the actuating lever.

4 Claims, 2 Drawing Sheets

APPARATUS AND METHOD FOR SPLITTING MASONRY MATERIALS

BACKGROUND OF THE INVENTION

The invention relates to a hydraulically operated apparatus for shearing or splitting masonry materials, such as stone, bricks and precast masonry blocks for landscaping and building construction purposes.

Use of decorative and structural stones, blocks and bricks for building construction and landscaping is well known. These materials have been extensively used as structural and decorative components of public, commercial, industrial and residential construction. Generally the sizing of such masonry material is provided by the quarry operator or the block manufacturer. However, on sight cutting or splitting of the masonry material is required to resize the material for structural or decorative construction purposes. Abrasive saws are used in situations where a smooth surface is required; however, a split cut face is preferable in situations where a rough brick, stone or block face surface is needed because such sheering is faster, cleaner and provides a decorative irregular surface. Such sheering is generally accomplished through the use of hydraulically operated apparatus, such as illustrated in U.S. Pat. No. 6,568,577.

It is a principal object of the present invention to provide a hydraulic masonry splitting apparatus which is faster and more efficient in operation.

SUMMARY OF THE INVENTION

The apparatus of the present invention for splitting masonry material includes a frame with a work support table vertically moveable in the frame with a lower blade attached to the table for supporting masonry material to be split on the table and overlying the lower blade. An upper blade is positioned in the frame over the table in alignment with the lower blade, and a hydraulic jack is supported in the frame below the table and is actuated by an actuating lever for thereby raising the ram of the jack, which engages and simultaneously raises the table together with its lower blade to engage masonry material supported thereon between the upper and lower blades for splitting. A mechanism is provided for more quickly raising the table with its attached lower blade, for thereby initially forcing the table upward at a faster rate for fast engagement of the upper and lower blades with the masonry material to be split upon initial actuation of the actuating lever.

After this initial blade engagement process is completed with unusually fast speed, the splitting process is continued by further compressing the blades together with the hydraulic jack ram until the masonry material splits. This provides a very fast and efficient stone splitting operation without the requirement of repeated pumping of the actuation lever as required by the prior art hydraulic splitters.

Thus, through the use of a single operating mechanism, the operation speed of the masonry material splitter is greatly improved by quickly raising simultaneously the work table with the lower blade by the hydraulic jack ram in order to split the masonry material more efficiently. Another advantage of the present invention is that through the use of this single actuating mechanism, even when a stone or block prevents the lower blade and support table from moving up because the stone or block completely consumes or occupies the space between the upper and lower blades, nevertheless, the hydraulic drive for the jack nevertheless is permitted to have full movement of its actuation capabilities.

The mechanism for causing this initial quick response for engagement of the blades to the masonry material to be cut includes a second hydraulic drive cylinder for actuating the jack which is actuated simultaneously by the same actuating lever that operates the primary drive for the hydraulic jack. In addition, a spring biased lever mechanism is provided in the form of a compression spring disposed between the head of the hydraulic jack ram and a lever flange positioned therebelow to provide an actuation cushion and to bias the actuating lever to its original starting position once the splitting process is completed.

In addition, the upper blade may be adjustably positioned within or on the frame for initially adjusting the spacing between the upper and lower blades to accommodate masonry material of different thicknesses.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

DETAILED DESCRIPTION OF A PREFERRED EMBODIMENT

Figure 1:
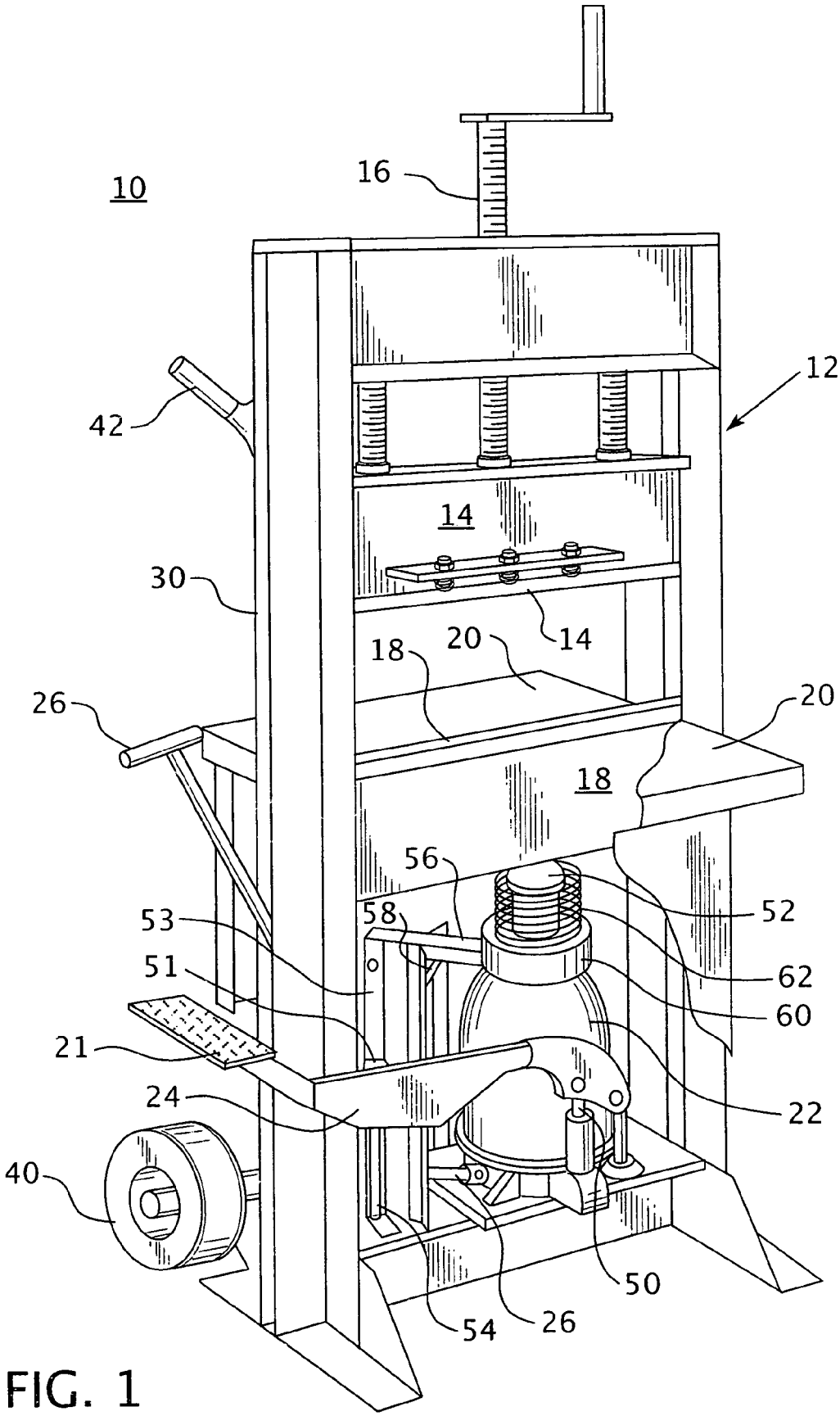
FIG. 1 is an isometric elevational view of the apparatus of the present invention for splitting masonry materials with a portion of the support table sectioned away.
Figure 2:
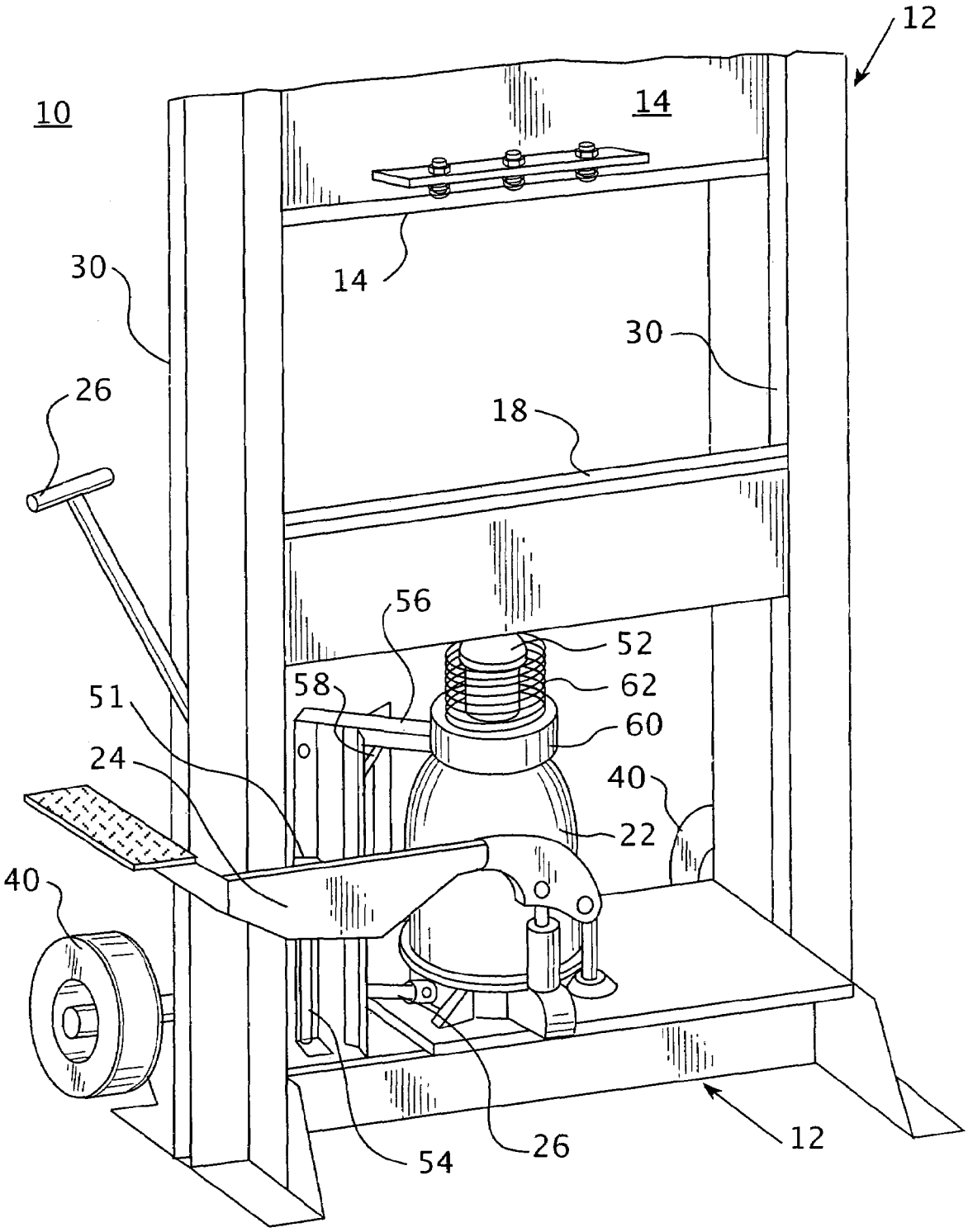
FIG. 2 is an elevational enlarged view of the apparatus shown in FIG. 1 with the upper portion thereof and support table removed to fully expose the operating mechanism.

Referring to the drawings, a masonry material splitter 10 of the present invention is illustrated. The splitter 10 includes a frame 12, a work support table 20 vertically moveable within frame 12 along with attached lower blade 18 in tracks 30. The combination of table 20 and lower blade 18 supports masonry material (not shown) thereon to be split.

An upper blade 14 is positioned in the frame 12 over table 20 in alignment with lower blade 18. Upper blade 14 may be preadjusted in spacing from lower blade 18 in tracks 30 by the acme screw height adjustment 16. A hydraulic ram 52 of conventional hydraulic bottle jack 22 is supported in frame 12 below table 20 and is actuated by hydraulic plunger rod 50, actuated by single actuating lever 24. The apparatus of the present invention improves the splitting process by providing a second hydraulic cylinder drive 53 which is also actuated by the single actuating lever 24, which simultaneously actuates plunger rod 50 of jack 22 and plunger rod 54 of drive 53 through connection 51.

When the foot pedal 21 on single actuating lever 24 is actuated by pressing downward thereon, the plunger 50 of jack 22 is actuated and simultaneously the plunger rod 54 of hydraulic drive 53 is also pressed downward and both of these hydraulic drives force hydraulic fluid into the hydraulic bottle jack 22 behind the ram 52 to raise the ram 52 and lower blade 18 and worktable 20 in combination at a fast rate.

The second hydraulic drive 53 is simultaneously depressed by the same actuating lever 24 and thereby also draws hydraulic fluid behind the ram 52 and raises the ram 52, lower blade 18 and table 20 more quickly than movement of plunger rod 50 alone can accomplish. When the hydraulic plunger rod 50 is depressed, the ram 52 of hydraulic jack 22 moves up under pressure about 1/16th to 1/8th of an inch. When hydraulic plunger rod 54 is depressed by actuating lever 24, ram 52 will move up approximately 2".

Also, hydraulic cylinder drive 53 connects to the arm 56 which in turn is pivoted on the fulcrum 58. The other end of arm 56 has a flange 60 with a compression spring 62 seated thereon, the spring operationally engaging between the head of the hydraulic ram 22 and flange 60. Thus, when lever 24 is depressed, hydraulic drive 53 is also depressed and the drive end of arm 56 moves downward as the other end forces flange 60 and compression spring 62 upward with ram 52 and lower blade 18 with table 20, so that the masonry material to be split is engaged between the lower blade 18 and the upper blade 14. Thus, this arrangement provides a mechanism for quickly raising the work table 20 with its attached lower blade 18 for initial very fast engagement of upper and lower blades 14 and 18 with the masonry material to be split upon initial actuation of the actuating lever 24. The splitting process is then continued by further depression of the actuating lever 24 which causes further actuation of the hydraulic drive plunger rod 50 and drive 53 to further actuate hydraulic jack 22 until the masonry material splits.

In situations where the masonry material or stone to be split fills or mostly fills the initially set space between the lower blade 18 and upper blade 14, the actuating lever 24 and the hydraulic plunger rod 50, are still permitted to fully actuate the hydraulic jack 22 and its ram 52 because the compression spring 62 compresses in order to allow full motion of plunger rod 50.

I claim:

1. An apparatus for splitting masonry material, the apparatus comprising:

a frame;

a table vertically moveable in said frame with an attached lower blade for supporting masonry material to be split;

an upper blade positioned in the fame over said table in alignment with said lower blade;

a hydraulic jack with a ram and supported in said frame below said table and actuated by an actuating lever for thereby raising said table and lower blade combination with said ram to engage masonry material supported thereon between said upper and lower blades for splitting; and means for raising said table with said attached lower blade and said hydraulic ram more quickly than said jack alone can perform for initial fast engagement of said upper and lower blades with the masonry material to be split upon initial actuation of said actuating lever;

said means further including a spring biased lever mechanism actuated by the initial actuation of said actuating lever to provide a continuous compression spring bias between said jack ram and said lever mechanism.

2. The apparatus of claim 1, wherein said spring bias is provided by a compression spring disposed between a head on said hydraulic jack ram and said lever mechanism positioned thereunder.

3. The apparatus of claim 1, wherein said upper blade is adjustably positioned on said frame for adjusting the initial spacing between said blades.

4. A method of splitting masonry material comprising;

providing a frame with an upper blade and a vertically moveable table positioned under said upper blade, said table having a lower blade attached thereto which is aligned with said upper blade for splitting masonry material between said blades under pressure provided by a ram of a hydraulic jack supported by said frame;

initially raising said ram by a lever mechanism under compression spring bias between said lever mechanism and said ram along with said table and lower blade for initial engagement of said blades with said masonry material to be split; and continuing by further compressing said blades together under bias of said spring with said jack by said lever mechanism until the masonry material splits.

* * * * *